US011662123B2

(12) United States Patent
Longsworth et al.

(10) Patent No.: US 11,662,123 B2
(45) Date of Patent: May 30, 2023

(54) REVERSIBLE PNEUMATIC DRIVE EXPANDER

(71) Applicant: Sumitomo (SHI) Cryogenics of America, Inc., Allentown, PA (US)

(72) Inventors: Ralph C. Longsworth, Mount Desert, ME (US); Mingyao Xu, Allentown, PA (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 25 days.

(21) Appl. No.: 17/404,598

(22) Filed: Aug. 17, 2021

(65) Prior Publication Data

US 2022/0065499 A1 Mar. 3, 2022

Related U.S. Application Data

(60) Provisional application No. 63/071,669, filed on Aug. 28, 2020.

(51) Int. Cl.
*F25B 41/20* (2021.01)
*F25B 9/10* (2006.01)
(Continued)

(52) U.S. Cl.
CPC ..... *F25B 9/10* (2013.01); *F25B 9/06* (2013.01); *F25B 9/14* (2013.01); *F25B 41/20* (2021.01);
(Continued)

(58) Field of Classification Search
CPC .... F25B 41/20; F25B 9/10; F25B 9/06; F25B 9/14; F25B 2309/003; F25B 2309/006
See application file for complete search history.

(56) References Cited

U.S. PATENT DOCUMENTS 3,045,436 A 7/1962 Gifford et al.
3,205,668 A 9/1965 Gifford
(Continued)

FOREIGN PATENT DOCUMENTS

JP 04-068267 A 3/1992
JP 2018-151129 A 9/2018
(Continued)

OTHER PUBLICATIONS

Taiwanese Office Action dated Nov. 2, 2022, for the Corresponding Taiwanese Patent Application No. 110131835.
(Continued)

*Primary Examiner* — Nael N Babaa
(74) *Attorney, Agent, or Firm* — Katten Muchin Rosenman LLP

(57) ABSTRACT

A pneumatically driven cryogenic refrigerator operating primarily on the Gifford-McMahon (GM) cycle is switched from cooling to heating by a switch valve between a rotary valve and a drive piston that causes the displacer to reciprocate. The rotary valve has ports at two radii, one that cycles flow to the displacer and a second that cycles flow to the drive piston. Two ports cycle flow to the top of the drive piston, the "cooling" port optimizes the cooling cycle and the "heating" port provides a good heating cycle. A switch valve that changes the flow from one port to the other can be linearly or rotary actuated. The rotary valve does not reverse direction.

14 Claims, 6 Drawing Sheets

(51) Int. Cl.
*F25B 9/14* (2006.01)
*F25B 9/06* (2006.01)

(52) U.S. Cl.
CPC ... *F25B 2309/003* (2013.01); *F25B 2309/006* (2013.01)

(56) References Cited

U.S. PATENT DOCUMENTS

| | | | |
|---|---|---|---|
| 5,361,588 | A | 11/1994 | Asami et al. |
| 7,191,600 | B2 | 3/2007 | Gao et al. |
| 8,448,461 | B2 | 5/2013 | Longsworth |
| 11,156,388 | B2 | 10/2021 | Durand |
| 2004/0123605 | A1 | 7/2004 | Pruitt et al. |
| 2011/0219810 | A1 | 9/2011 | Longsworth |
| 2020/0003465 | A1 | 1/2020 | Xu et al. |

FOREIGN PATENT DOCUMENTS

| | | | |
|---|---|---|---|
| KR | 10-2018-0108666 | A | 10/2018 |
| TW | M425258 | U1 | 3/2012 |
| WO | 2018/168304 | A1 | 9/2018 |
| WO | 2018/168305 | A1 | 9/2018 |

OTHER PUBLICATIONS

International Search Report and Written Opinion of the International Searching Authority dated Nov. 25, 2021, from the corresponding International Application No. PCT/US2021/046302.

REVERSIBLE PNEUMATIC DRIVE EXPANDER

CROSS REFERENCE TO RELATED APPLICATIONS

This application claims the priority of U.S. Provisional Application Ser. No. 63/071,669, filed on Aug. 28, 2020, which is hereby incorporated herein by reference in its entirety.

FIELD OF THE INVENTION

This invention relates to a pneumatic drive mechanism for a reciprocating cryogenic expander that incorporates a valve that switches between producing cooling or heating.

BACKGROUND

Semiconductors are being manufactured in vacuum chambers that typically use cryopumps cooled by Gifford-McMahon (GM) refrigerators to produce the vacuum. A typical cryopump has a warm panel cooled to about 80 K on which group I gases, including water vapor, freeze and a cold panel cooled to about 20 K on which group II gases, such as nitrogen and oxygen, freeze. Charcoal on the backside of the cold panel adsorbs the lighter gases hydrogen and helium. After operating for several days or weeks the cryopump has to be warmed up to remove the cryodeposits. Combustible combinations of gases can accumulate in a cryopump so heaters inside the cryopump are avoided and the cryopanels are typically indirectly warmed by heaters on the outside of the cryopump housing. Most GM type expanders in use these days produce cooling when run in one direction and continue to produce cooling at a reduced rate when run in reverse. Having a cryopump with an expander that can alternately produce heating gives options for warming up faster, or at a reduced cost, or both.

U.S. Pat. No. 3,045,436 ("the '436 patent") by W. E. Gifford and H. O. McMahon describes the GM cycle. The systems described herein operate primarily on the GM cycle and in general have input powers in the range of 5 to 15 kW, but larger and smaller systems can fall within the scope of this invention. GM cycle, and many Brayton cycle, refrigerators use oil lubricated compressors designed for air conditioning applications to supply gas (helium) to reciprocating cryogenic expanders. A GM expander cycles gas to the cold expansion space through inlet and outlet valves at room temperature and a regenerator, while a Brayton cycle expander has a counter-flow heat exchanger with gas entering and leaving at room temperature and cold inlet and outlet valves that cycle gas to the cold expansion space. The displacer in the expander is either driven mechanically or pneumatically.

U.S. Pat. No. 3,205,668 ("the '668 patent") by Gifford describes a GM expander that has a stem attached to the warm end of the displacer which drives the displacer up and down by cycling the pressure above the drive stem out of phase with the pressure to the expansion space by means of a rotary valve. With the valve rotating in a forward direction a cycle may assume to start with the displacer down (cold displaced volume minimal) and at low pressure and the pressure above the stem high. Pressure to the displacer is switched to high pressure followed after a brief delay of the pressure to the drive stem being switched to low pressure. This causes the displacer to move up drawing high pressure gas through the regenerator into the cold displaced volume.

The high pressure valve to the displacer is usually closed before the displacer reaches the top and there is a partial expansion of the gas as it reaches the top. The low pressure valve to the displacer is then opened and the expanding gas gets cold. The pressure above the drive stem is then switched to high pressure and pushes the displacer down, pushing the cold low pressure gas through the cold end heat exchanger and back out through the regenerator, completing the cycle. When the pressure to the displacer switches, the pressure drop through the regenerator results in a force that is in the same direction as the force on the drive stem. When the pressure-displacement relations, P-V, are plotted on a diagram the sequence of the relations is in a clockwise direction and the area is equal to the cooling produced per cycle. When the rotary valve of the '668 patent is run in reverse the pressure to the drive stem switches before the pressure to the displacer and the P-V sequence is still in a clockwise direction but the cooling is reduced because of the poor timing. During phases of the cycle when the pressures in the displacer and on the drive stem are the same there is no net force to move the displacer.

U.S. Pat. No. 8,448,461 ("the '461 patent") by Longsworth describes a Brayton cycle expander having a stem on the displacer/piston that is pneumatically driven and can use the mechanism of this invention to switch from a cooling to a heating cycle. The mechanism of this invention can also be used to implement the adjustment of the orifice that controls the speed at which the displacer/piston moves up and down to optimize the cooling during cool down. Most Brayton cycle expanders have a piston with a seal that separates the cold displaced volume from the warm end while the '461 patent has a piston with a regenerator in it that equalizes the pressures in the warm and cold displaced volumes and can thus be referred to as a displacer.

In order for an expander to produce heating when run in reverse the displacer has to be at or near the top when the pressure is switched from low to high pressure, and stay there despite the downward force from the regenerator pressure drop, so that the cold displaced volume is heated by the gas being compressed there. This hot gas at high pressure is pushed out through the regenerator and the pressure is switched to low pressure when the displacer is down. This has been accomplished with a Scotch Yoke driven displacer having a rotary valve as described in U.S. Pat. No. 5,361,588 ("the '588 patent") by Asami. The Scotch Yoke drive fixes the position of the displacer as the motor rotates regardless of the pressure. The timing of gas flowing in and out of the displacer through the valve as it rotates in the forward direction is optimized to produce refrigeration. The rotary valve disc has a face that slides over ports in a valve seat and is turned by a valve motor having a shaft with a pin that engages a slot on the back side of valve disc. The valve disc of the '588 patent has an annular slot that changes the angle at which the pin engages the slot. This results in the high pressure port opening when the displacer is at the top and moves down and the low pressure port being open when the displacer is at the bottom and moves to the top. The P-V sequence is counterclockwise. The valve timing is such that a near optimal heating cycle is achieved.

As the cooling capacity of expanders is increased for cooling larger cryopumps the Scotch Yoke drive becomes much larger and more expensive than a pneumatic drive, thus the need for a more efficient pneumatically driven expander that can be changed from a cooling to a heating cycle.

U.S. Pat. No. 7,191,600 ("the '600 patent") by Gao and Longsworth describes a Pulse Tube expander that has separate rotary valves for the flow to the regenerator and the flow to the pulse tube. When the valve motor is turning in a forward direction the phase difference between the two valves produces cooling and when turning in the opposite direction there is a phase shift between the two valves that produces heating. Patent application WO 2018/168305 ("the '305 application") describes a different valve configuration for a Pulse Tube expander than the one described in the '600 patent that produces heating when run in reverse.

The principle of the '588 patent is to have the mechanism that drives the displacer up and down, a Scotch Yoke, be independent of the valve, a rotary valve, that switches the pressures to the displacer, and that the phasing of the pressure switching is shifted when changing the direction of rotation. Patent application WO 2018/168304 ("the '304 application") describes a pneumatic drive for the displacer that has a piston attached to a drive stem that is larger than the drive stem and is connected to inlet and outlet valves that are different than the ones connected to the displacer. The valves are concentric discs sliding on a fixed valve seat. The inner disc switches flow to the displacer and the outer disc switches flow to the top of the drive piston. When the valve motor is run in reverse the outer disc rotates through a fixed angle with respect to the inner disc and provides the phase shifting needed to produce heating rather than cooling. FIGS. 8*a*-8*d* show FIGS. 1, 8(a), 8(c) and 9(c) of the '304 application, respectively. The gas on the back side of the drive piston in volume 48 is trapped between the seals 50, 32 on the drive piston and drive stem, as shown in FIG. 8*a*. It cycles around an average pressure that depends on the volume of 48. In order to achieve the rectangular P-V diagram shown in FIG. 8*c*, volume 48 has to be at least twice as large as the volume above the drive piston, 46. FIG. 8*b* shows that valves V3 and V4, which control flow to the drive stem, open with a difference of 180° and stay open the same length of time, while valve V2 opens about 100° after V1 and stays open the same length of time. While this asymmetry may provide optimum timing for cooling, it results in less than optimum timing for heating as reflected in the smaller P-V diagram shown in FIG. 8*d*. It is an important aspect of the present invention that the timing of opening and closing the equivalent of the valves to the drive stem can be different when switching from cooling to heating.

SUMMARY

The object of this invention is to switch from cooling to heating with a pneumatically driven GM type expander without reversing the direction of the drive motor, and while providing valve timing for cooling and heating that results in good efficiency for both. The high efficiency when both cooling and warming is achieved by reciprocating the expander displacer with a drive piston that can drive the displacer to the ends of the stroke regardless of the pressure in the displacer, using a rotary valve that has separate tracks for switching pressures to the displacer and the drive piston, and having a separate switch valve that changes the flow from a port on the track for the drive piston that results in cooling to a second port that results in heating. The switch valve can be actuated by either a linear or rotary drive. The drive piston can be either single acting or double acting and the actuator can simply switch the flow to the drive piston or be connected to a controller that also changes the pressure drop through the switch valve to control the speed at which the displacer moves up and down.

These advantages may be achieved by a cryogenic expander for receiving gas from a compressor at a first pressure and returning the gas at a second pressure. The cryogenic expander includes a displacer assembly pneumatically driven and reciprocating and a valve assembly capable of providing cooling and heating modes to respectively produce cooling and heating. The displacer assembly includes a displacer in a displacer cylinder reciprocating between a warm end and a cold end of the displacer cylinder, a drive stem attached to a warm end of the displacer and extending through a stem sleeve, and a drive piston having a top and a bottom with the bottom of the drive piston attached to a top end of the drive stem, reciprocating in a drive piston cylinder. The drive piston may have a larger diameter than the drive stem. Gas flows between the warm and cold displaced volumes through a regenerator. The valve assembly includes a valve seat and a valve disc rotating on the valve seat. The valve seat has ports at a first radius that connects to the displacer cylinder or valve actuators, ports at a second radius that connect to the drive piston cylinder, and a central port that connects to the compressor at the second pressure. The valve disc has slots that alternately connect the gas at the first pressure and second pressure to the ports at the first and second radii. The ports at the second radius include a cooling port and a heating port. The direction of rotation of the valve disc remains constant. The valve assembly further includes a switch valve between the ports at the second radius and the top volume above the drive piston. The switch valve is configured to connect either the cooling port or the heating port to the top volume above the drive piston to provide either the cooling or heating mode.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTIONS

Figure 1:
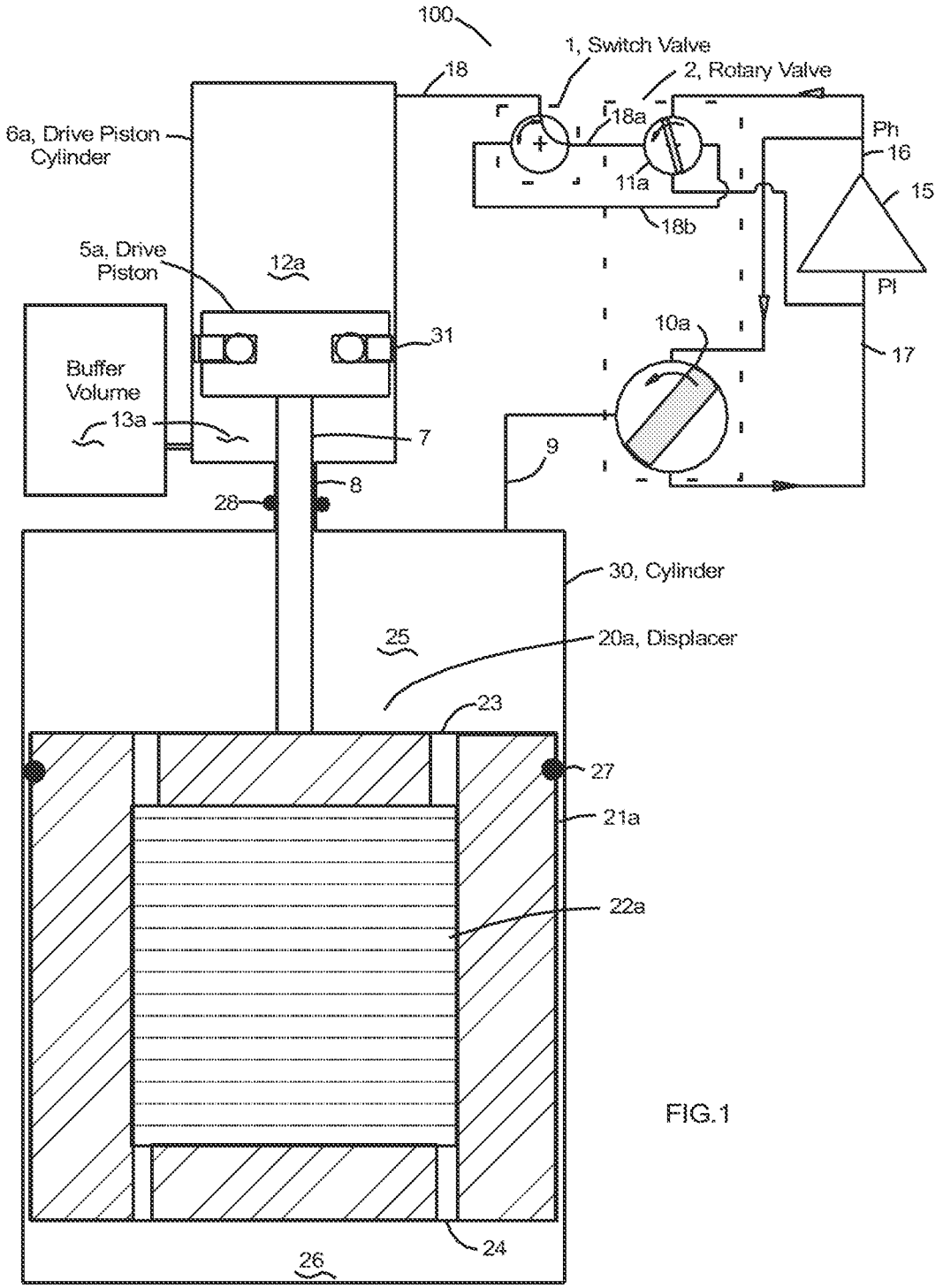
FIG. 1 is a schematic of cryogenic refrigeration system 100 comprising a pneumatically actuated GM cycle expander having a single acting drive piston, a rotary valve, and a switch valve, supplied with gas from a compressor through interconnecting piping.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

Cryogenic expanders typically operate with the cold end down so the terminology up and down and top and bottom are in reference to this orientation. The same numbers are used for the same components in the drawings and subscripts are used to distinguish the equivalent part with a different configuration.

With reference to FIG. 1, shown is a schematic of cryogenic refrigeration system 100 that shows in detail the central features of this invention, the valves and drive piston, in relation to the rest of the system, namely displacer 20*a* in cylinder 30, and compressor 15 which supplies gas at a first pressure, or high pressure Ph, to rotary valve 2 through line 16, and receives gas at a second pressure, or low pressure Pl, from rotary valve 2 through line 17. Rotary valve 2 has ports on a rotating disc that pass over ports on a stationary seat. Ports on the seat at a first radius 10*a* cycle gas to the warm end of displacer cylinder 30 through line 9, and ports at a second radius 11*a* cycle gas through switch valve 1 and line 18 to the top end of drive piston cylinder 6*a*. Line 18*a* starts at a first port on the second radius 11*a* of the valve seat, designated as the cooling port, and line 18*b* starts at a second port on the second radius 11*a* of the valve seat, designated as the heating port. The schematic drawing of switch valve 1 shows it is fixed in the position for cooling and is turned 90° counter-clockwise for heating. The schematic drawing of valve 2 shows gas in line 9 connected to cylinder 30 at high pressure, Ph, and gas in line 18 connected to cylinder 6*a* at low pressure, Pl, as displacer 20*a* is moving up.

Displacer 20*a* reciprocates in cylinder 30 between a warm end and a cold end creating warm displaced volume 25 and cold displaced volume 26. Gas flows between volumes 25 and 26 through ports 23 at the warm end, regenerator 22*a*, and ports 24 at the cold end in displacer body 21*a*. Seal 27 prevents gas from by-passing regenerator 22*a*. Displacer 20*a* is driven up and down by drive stem 7 which is connected at its bottom end to the top end of displacer 20*a* and at its top end to the bottom end of drive piston 5*a*. Drive piston 5*a* is driven up and down by the pressure difference between the cycling gas pressure in volume 12*a* above drive piston 5*a* and the pressure in buffer volume 13*a* below drive piston 5*a* acting on the area outside drive stem 7. Because drive piston 5*a* is only driven by the pressure changing from high pressure, Ph, to low pressure, Pl, on one side of the piston it is described as single acting. Seal 31 in the drive piston 5*a* keeps gas in volume 12*a* separate from the gas in volume 13*a*. Seal 28 in stem sleeve 8 keeps gas in volume 13*a* separate from the gas in volume 25.

Typical operating pressures are around 2.2 MPa for the supply pressure, Ph, and 0.8 MPa for the return pressure, Pl, a pressure ratio of 2.8, so buffer volume 13*a* has to be more than about three times larger than displaced volume 12*a* in order for drive piston 5*a* to complete a full stroke. A much larger volume however is needed to reduce the pressure change in volume 12*a* to have nearly constant pressure difference across drive piston 5*a* during the full stroke. This large volume of buffer volume 13*a*, relative to volume 12*a*, is shown schematically as a separate volume from the displaced volume below drive piston 5*a*.

Figure 2:
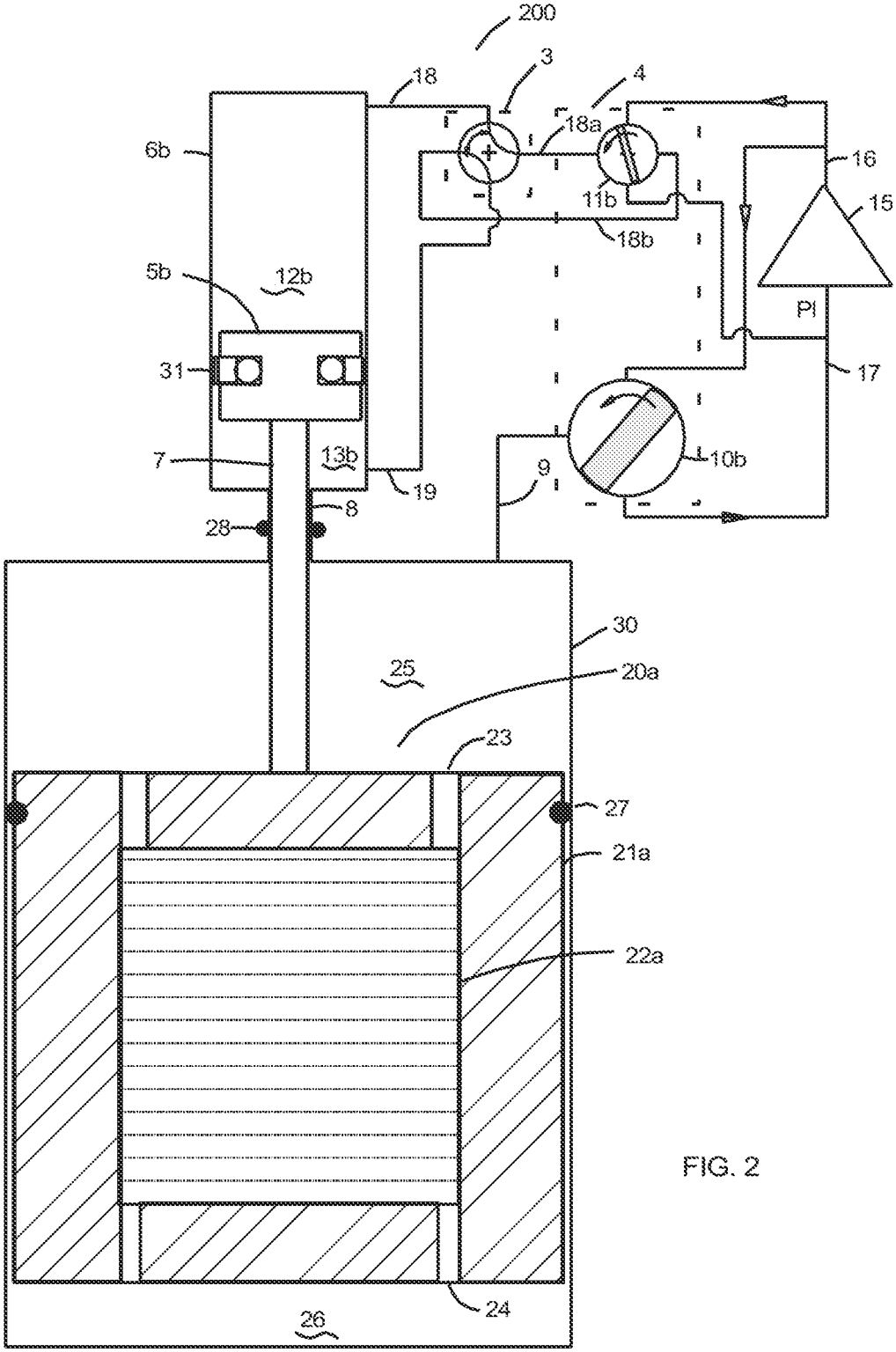
FIG. 2 is a schematic of cryogenic refrigeration system 200 comprising a pneumatically actuated GM cycle expander having a double acting drive piston, a rotary valve, and a switch valve, supplied with gas from a compressor through interconnecting piping.

With reference to FIG. 2, shown is a schematic of cryogenic refrigeration system 200 which differs from system 100 in having a double acting drive piston 5*b*. The pressure on the bottom of drive piston 5*b* is low pressure Pl when the pressure on top is high pressure Ph, and is high pressure Ph when the pressure on top is low pressure Pl. In system 100, line 18*b* from the heating port in rotary valve 2 is blocked at switch valve 1 during cooling, but in system 200 it is connected to volume 13*b*, below drive piston 5*b*, through switch valve 3 and line 19. Double acting drive piston 5*b* can have a smaller diameter than single acting drive piston 5*a* because the full pressure difference, Ph−Pl, acts on it, and volumes 12*b* and 13*b* above and below drive piston 5*b* can be as small as the volume displaced by drive piston 5*b*.

Rotary valve 4 is similar to rotary valve 2 in having the port at a first radius on the valve seat to line 9 and second radius 10*b*, and in having the port at a second radius, 11*b* to lines 18*a* and 18*b*, and to line 18. Switch valve 3 is constructed such that gas from heating line 18*b* in rotary valve 4 connects to line 19 when gas from cooling line 18*a* connects to line 18, thus switching the pressures above and below drive piston 5*b* to opposite pressures as valve disc 4 rotates.

Switch valve 3 is fixed in the position shown for cooling and is turned 90° counter-clockwise for heating. The schematic drawing of valve 4 shows gas in line 9 connected to cylinder 30 at high pressure, Ph, gas in line 18, connected to the top of cylinder 6*b* at low pressure, Pl, and gas in line 19, connected to the bottom of cylinder 6*b* at high pressure, Ph, as displacer 20*a* is moving up. While the mechanism for shifting a pneumatically driven cryogenic expander from cooling to heating is most applicable to a cryopump cooled by a GM cycle expander, it can also be applied to a pneumatically driven Brayton cycle expander as shown in FIG. 3.

Figure 3:
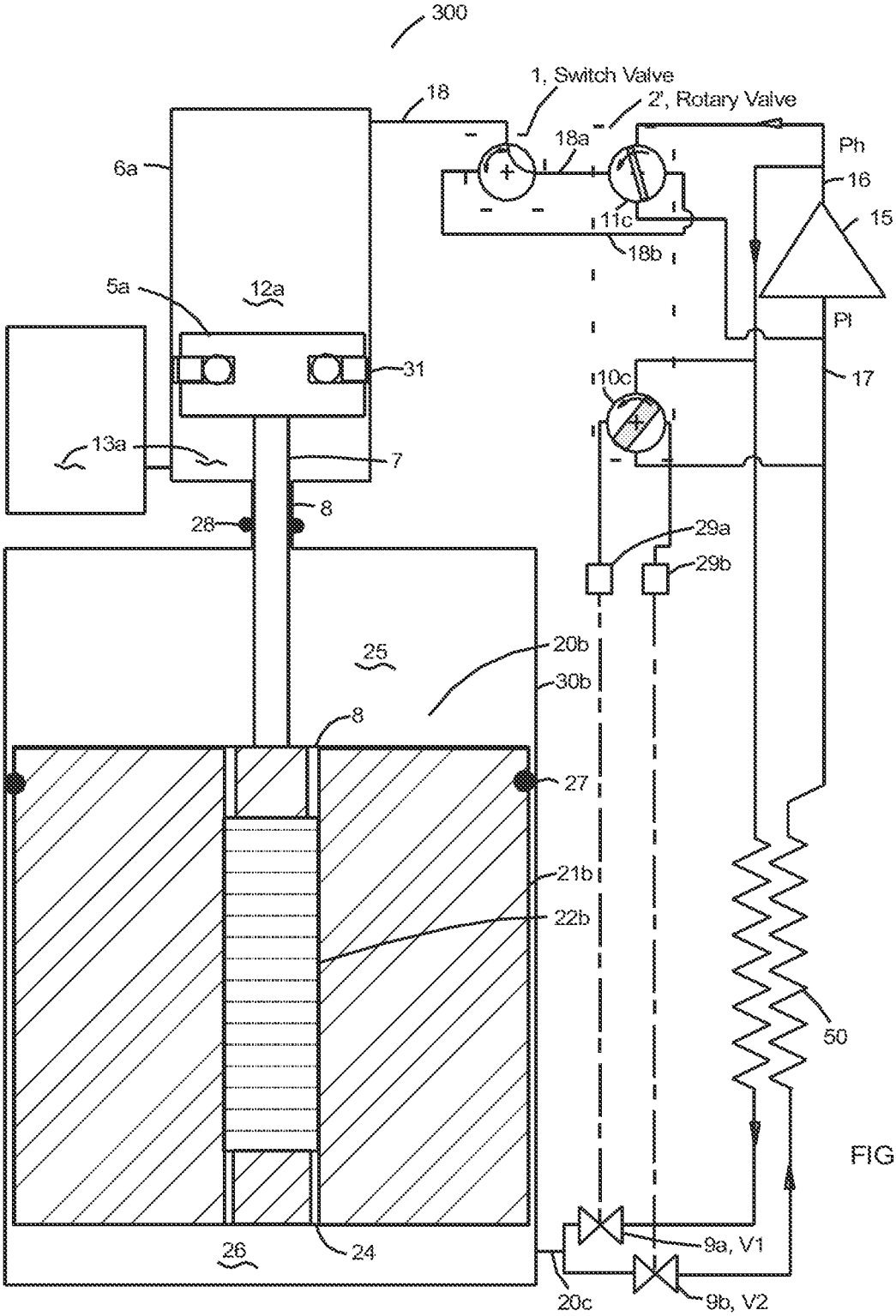
FIG. 3 is a schematic of cryogenic refrigeration system 300 comprising a pneumatically actuated Brayton cycle expander having a single acting drive piston, a rotary valve, and a switch valve, supplied with gas from a compressor through interconnecting piping.

With reference to FIG. 3, shown is a schematic of cryogenic refrigeration system 300 comprising a pneumatically actuated Brayton cycle expander having a single acting drive piston. The Brayton cycle expander of system 300 has the main inlet and outlet valves, 9*a* and 9*b*, at the cold end of cylinder 30*b*. Gas flows from compressor 15 to inlet valve 9*a* from high pressure line 16 through counter-flow heat exchanger 50, and returns from outlet valve 9*b* through heat exchanger 50 and low pressure line 17. Displacer 21*b* has a regenerator, 22*b*, which cycles gas from cold end volume 26 to warm end volume 25 to keep the pressures above and below displacer 21*b* nearly the same and allow the valve mechanism and drive piston mechanism of system 100 or system 200 to be used to produce cooling or heating. The ports on rotary valve 2' at the first radius 10*c* are relatively small since they only cycle a small amount of gas to pneumatic actuators 29*a* and 29*b* that open and close cold inlet and outlet valves 9*a* and 9*b*. Pneumatic actuator 29*a* opens valve 9*a* when it is connected to high pressure Ph and is closed when connected to low pressure Pl. The same is true for actuator 29*b* and valve 9*b*.

Figure 4:
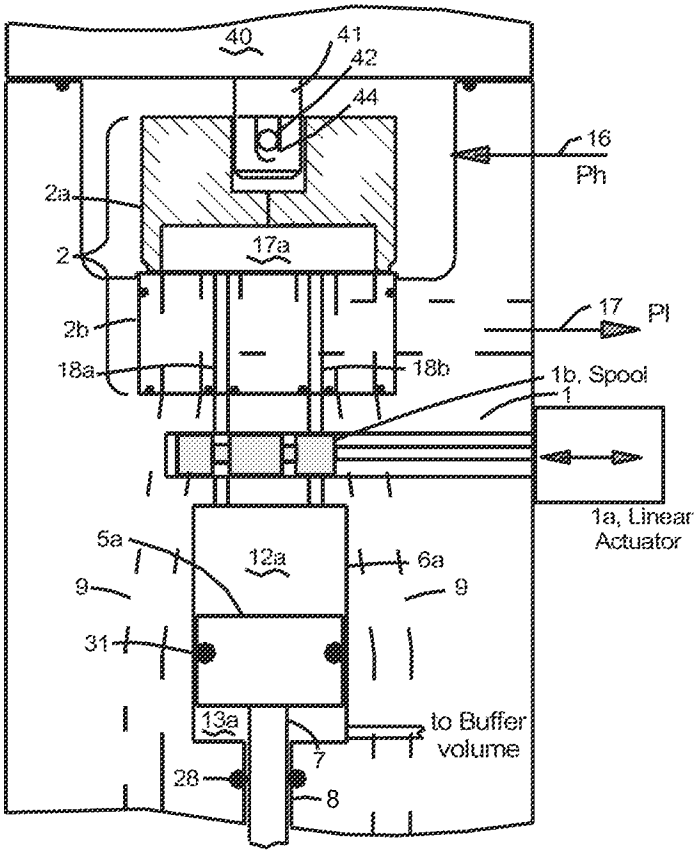
FIG. 4 shows a cross section of the rotary valve, the switch valve, and the drive piston of system 100.

With reference to FIG. 4, shown is a cross section of switch valve 1, rotary valve 2, and drive piston 5*a* of system 100. Rotating disc 2*a* is turned by valve motor 40, motor shaft 41, and pin 42 that engages slot 44 in the top of disc 2*a*. Valve discs shown for this invention have two cycles per revolution and thus have two symmetrical high and low pressure slots. The valve seats have two symmetrical ports for flow to the displacer but may have only one pair of ports for flow to the drive piston. The bottom of valve disc 2*a* is in contact with valve seat 2*b* and is shown with slot 17*a* that connects low pressure return port 17 with line 18*a* to drive piston volume 12*a* through spool 1*b*. This is the cooling mode. System 100 switches to a heating mode when linear actuator 1*a* pulls spool 1*b* to the right such that line 18*b* connects to drive piston volume 12*a*. Lines 18*a* and 18*b* may have different flow impedances so that the speeds at which drive piston 12*a* moves up and down in the heating and cooling modes may be different. The different flow impedances may be established by the degree to which the switch valve is opened or by fixed port sizes. Controlling the degree to which the switch valve is opened may be used to control the piston speed.

The switch valve 1 may be configured such that only the cooling port 18*a* fluidly communicates with the top volume 12*a* above the drive piston 5*a* when the expander is in the cooling mode and only the heating port 18*b* fluidly communicates with the top volume 12*a* above the drive piston 5*a* when the expander is in the heating mode. The linearly activating actuator 1*a* may be configured to control the pressure drop through the switch valve 1 to control the speed at which the displacer 20*a* moves up and down.

Figure 5:
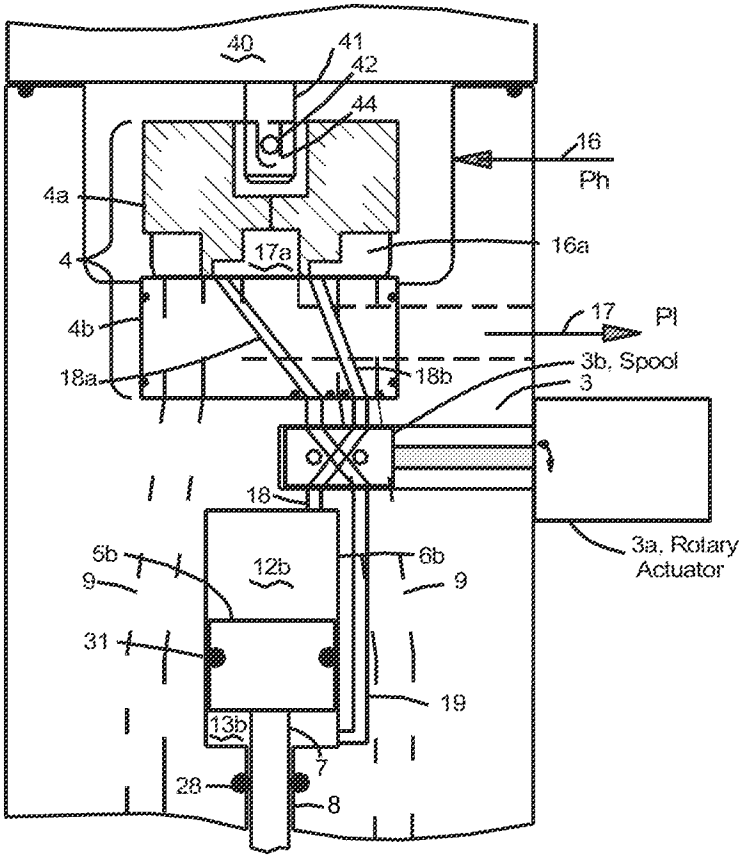
FIG. 5 shows a cross section of the rotary valve, the switch valve, and the drive piston of system 200.

With reference to FIG. 5, shown is a cross section of switch valve 3, rotary valve 4, and drive piston 5*b* of system 200. The bottom of valve disc 4*a* is in contact with valve seat 4*b* and is shown with slot 16*a*, which connects high pressure supply port 16 with line 18*b* to drive piston volume 12*b* through spool 3*b* and line 18, and slot 17*a* which connects low pressure return port 17 with line 18*a* to drive piston volume 13*b* through spool 3*b* and line 19. This is the heating mode. System 200 switches to a cooling mode when rotary actuator 3*a* turns spool 3*b* 90° such that line 18*a* connects to drive piston volume 12*b* and line 18*b* connects to piston volume 13*b*.

Figure 7A:
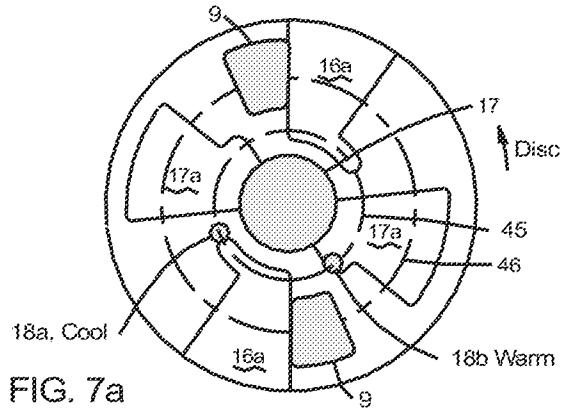
FIG. 7*a* shows the pattern of slots in the valve disc, superimposed on the valve seat, when the displacer in system 100 is about to be pressurized to high pressure.
Figure 6A:
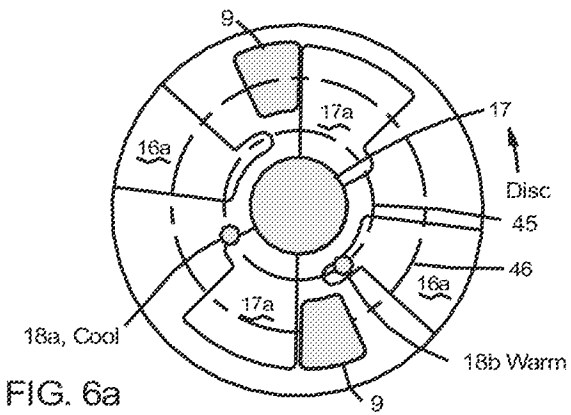
FIG. 6*a* shows the pattern of slots in the valve disc, superimposed on the valve seat, when the displacer in system 100 is about to be vented to low pressure.
Figure 6B:
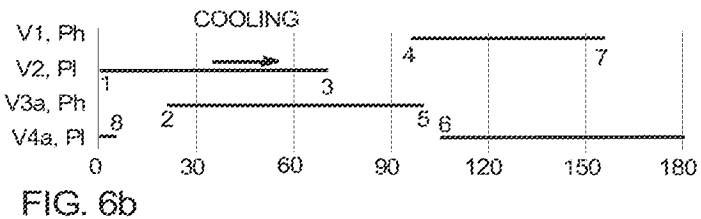
FIG. 6*b* shows the sequence of the slots in the valve disc of system 100 passing over the ports in the valve seat as the valve disc rotates when the expander is producing cooling.
Figure 6C:
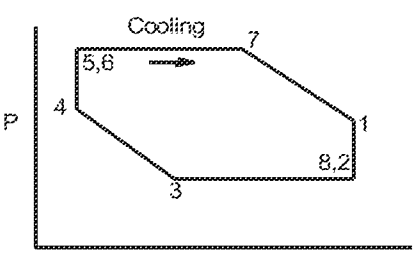
FIG. 6*c* shows the P-V diagram for a cooling cycle with the points on the cycle numbered as shown in FIG. 6*b*.
Figure 8A:
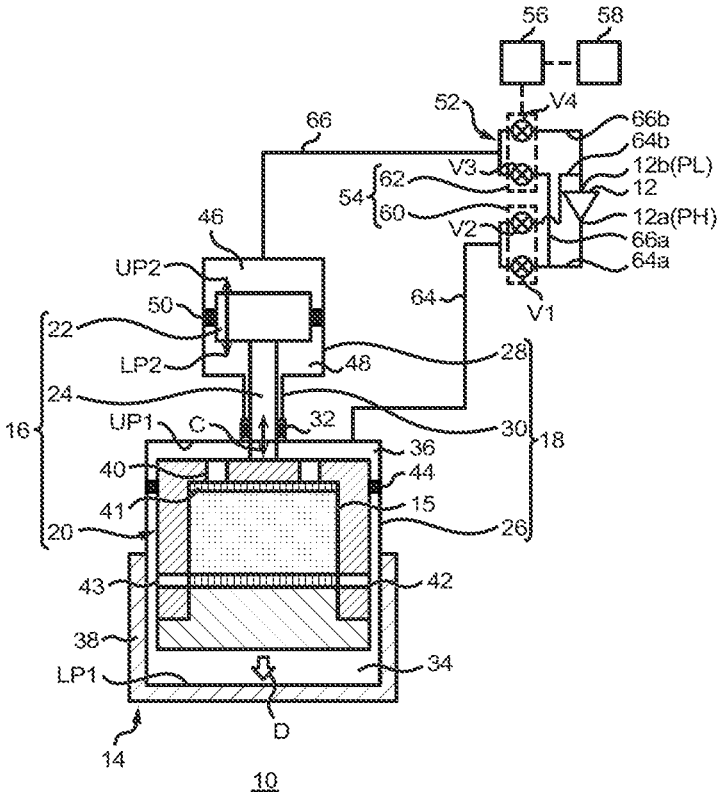
FIGS. 8*a*-8*d* show FIGS. 1, 8(a), 8(c) and 9(c) of the '304 application, respectively.
Figure 8B:
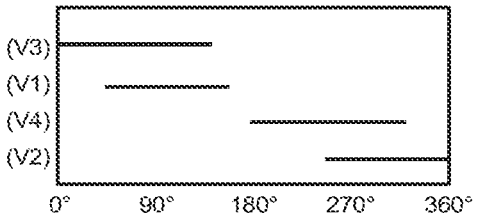
Figure 8C:
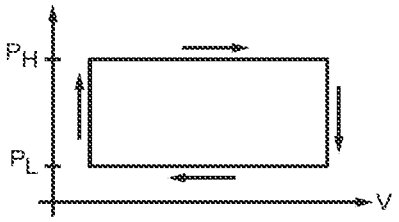
Figure 8D:
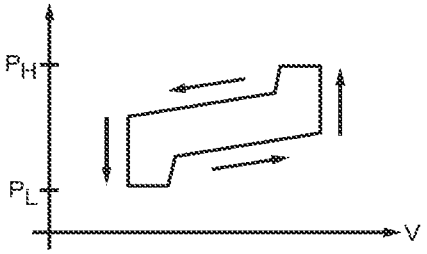

FIGS. 6*a* and 7*a* exemplarily show rotary valves of systems 100-300 in two positions. FIG. 6*b* for cooling and FIG. 7*b* for heating, show the timing of the high and low pressure slots in the valve disc passing over the ports in the valve seat, which is the equivalent of opening and closing valves. FIGS. 6*c* and 7*c* then show the opening and closing of the valves on P-V diagrams for cooling and heating. FIGS. 6*a* and 7*a* show slots 16*a* and 17*a* in the face of valve disc 2*a* looking at it from the valve motor and turning counter-clockwise against valve seat 2*b*. Port 9 in valve seat 2*b* at a first radius 46 connects to displacer cylinder 30 and opens as valve V1 (see FIG. 6*b*) when high pressure slot 16*a* passes over it and as low pressure valve V2 when low pressure slot 17*a* passes over it. Lines 18*a* and 18*b* in valve seat 2*b* at a second radius 45 connect to the top of drive piston cylinder 6*a* and open as valves V3a and V3b when high pressure slot 16*a* passes over them and as low pressure valves V4a and V4b when low pressure slot 17*a* passes over them. Switch valve 1 blocks the flow from line 18*b* when the expander is cooling and blocks the flow from line 18*a* when the expander is heating.

FIGS. 6*a*, 6*b*, and 6*c* show the cooling cycle starting at the end of the expansion stage with cold displaced volume 26 at a maximum, displacer 20*a* at the top, and the pressure greater than the low pressure, Pl. The numerals 1-8 in FIGS. 6*b* and 6*c* show valve timing and the corresponding P-V cycles which are summarized as follow.

1: Valve V2 opens so that pressure in the displacer drops to low pressure Pl.

2: After the pressure has dropped to Pl, V3a opens and the pressure difference across the drive piston pushes the displacer towards the bottom.

3: Before the displacer reaches the bottom, V2 closes so that the pressure increases as cold gas is transferred to the warm end while the displacer moves the rest of the way to the bottom.

4: V1 opens so that the pressure increases to high pressure Ph.

5: V3 closes.

6: V4 opens and the pressure difference across the drive piston pushes the displacer towards the top.

7: Before the displacer reaches the top, V1 closes so that the pressure decreases as warm gas is transferred to the cold end while the displacer moves the rest of the way to the top.

8: V4 closes.

There are two principles in this cycle, first is that the pressures in the drive piston are switched after the pressures in the displacer are switched, and second, valves V1 and V2 close before the displacer reaches the end of the stroke, top and bottom.

Figure 7B:
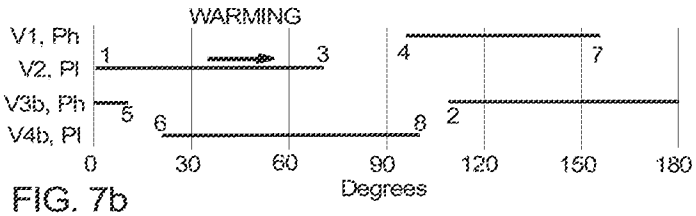
FIG. 7*b* shows the sequence of the slots in the valve disc of system 100 passing over the ports in the valve seat as the valve disc rotates when the expander is producing heating.
Figure 7C:
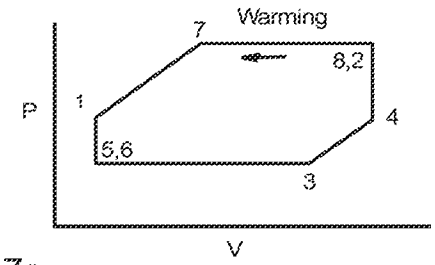
FIG. 7*c* shows the P-V diagram for a heating cycle with the points on the cycle numbered as shown in FIG. 7*b*.

FIGS. 7*a*, 7*b*, and 7*c* show the heating cycle starting at the beginning of the low pressure stage with displaced volume 26 at a minimum, displacer 20*a* at the bottom, and the pressure greater than the low pressure, Pl. The numerals 1-8 in FIGS. 7*b* and 7*c* show valve timing and the corresponding P-V cycles which are summarized as follow.

1: Valve V2 opens so that pressure in the displacer drops to Pl. Note that valve V3b is still open keeping high pressure gas on drive piston 5*a* to hold it down.

6: After the pressure has dropped to Pl, V4b opens so that the pressure difference across the drive piston pulls the displacer towards the top.

3: Before the displacer reaches the top, V2 closes so that the pressure increases as warm gas is transferred to the bottom end while the displacer moves the rest of the way to the top.

4: V1 opens so the pressure increases to high pressure, Ph. Note that V4b is still open causing the drive piston to hold the displacer at the top.

7: V1 closes followed by the pressure dropping as the displacer moves to the bottom and gas is transferred from the cold end to the warm end.

There are three principles in this cycle. The first is that the pressure above the drive piston holds the displacer at the top or bottom when valves V1 and V2 switch pressure. The second is that the pressure above the drive piston is switched after high or low pressure is reached, and the third is that valves V1 and V2 are closed before the displacer reaches top or bottom. It is important to note that optimizing the cooling cycle by having V2 open longer than V1 and having V1 open more than 90° after V2 does not penalize the heating cycle because heating line 18*b* can be located more than 90° from cooling line 18*a*.

The valve timing for system 300 can be the same as for system 100. Representations of the valve and valve timing for system 200 would show more symmetry because the pressures above and below drive piston 5*b* have to switch at the same time. Compromises are thus needed to balance a good cooling cycle with a good heating cycle.

The following claims are not limited to the specific components that are cited. For example switch valve 1 which is shown as being linearly actuated can be replaced with a rotary activated valve. The heating port on the second radius can alternately be on a third radius. It is also within the scope of these claims to include operating limits that are less than optimum to simplify the mechanical design. The terms and descriptions used herein are set forth by way of illustration only and are not meant as limitations. Those skilled in the art will recognize that many variations are possible within the spirit and scope of the invention and the embodiments described herein.

What is claimed is:

1. A cryogenic expander for receiving gas from a compressor at a first pressure and returning the gas at a second pressure, comprising:

a displacer assembly pneumatically driven and reciprocating, comprising:

a displacer in a displacer cylinder reciprocating between a warm end and a cold end of the displacer cylinder, creating a warm displaced volume and a cold displaced volume in the displacer cylinder, gas flowing between the warm and cold displaced volumes through a regenerator;

a drive stem attached to a warm end of the displacer and extending through a stem sleeve; and a drive piston having a top and a bottom, the bottom of the drive piston attached to a top end of the drive stem, reciprocating in a drive piston cylinder, the drive piston having a larger diameter than the drive stem, the drive piston separating a top volume above the drive piston and a bottom volume below the drive piston; and a valve assembly capable of providing cooling and heating modes to respectively produce cooling and heating, comprising;

a valve seat;

a valve disc rotating on the valve seat, wherein the valve seat has ports at a first radius that connects to the displacer cylinder or valve actuators, ports at a second radius that connect to the drive piston cylinder, and a central port that connects to the compressor at the second pressure, the valve disc has slots that alternately connect the gas at the first pressure and second pressure to the ports at the first and second radii, and the ports at the second radius comprise a cooling port and a heating port, and wherein a direction of rotation of the valve disc remains constant; and a switch valve between the ports at the second radius and the top volume above the drive piston, wherein the switch valve is configured to connect either the cooling port or the heating port to the top volume above the drive piston to provide either the cooling or heating mode.

2. The cryogenic expander in accordance with claim 1 wherein the switch valve is configured to connect the heating port to the bottom volume below the drive piston when the expander is in the cooling mode, and to connect the cooling port to the bottom volume below the drive piston when the expander is in the heating mode.

3. The cryogenic expander in accordance with claim 2 wherein the switch valve is configured to connect the cooling port to the top volume above the drive piston when the expander is in the cooling mode, and to connect the heating port to the top volume above the drive piston when the expander is in the heating mode.

4. The cryogenic expander in accordance with claim 2 wherein the switch valve comprises a spool configured to rotationally switch the connections of the heating port and cooling port to the bottom volume below the drive piston.

5. The cryogenic expander in accordance with claim 1 wherein the switch valve is configured such that only the cooling port fluidly communicates with the top volume above the drive piston when the expander is in the cooling mode and only the heating port fluidly communicates with the top volume above the drive piston when the expander is in the heating mode.

6. The cryogenic expander in accordance with claim 5 wherein the switch valve comprises a spool configured to linearly switch the communications of the cooling port and heating port with the top volume above the drive piston.

7. The cryogenic expander in accordance with claim 5 wherein lines respectively connecting the cooling port and the heating port to the top volume above the drive piston have different flow impedances.

8. The cryogenic expander in accordance with claim 1 wherein the switch valve comprises:

a spool to connect either the cooling port or the heating port to the top volume above the drive piston; and an actuator to activate the spool linearly or rotationally.

9. The cryogenic expander in accordance with claim 8 wherein the linearly activating actuator is configured to control pressure drop through the switch valve to control the speed at which the displacer moves up and down.

10. The cryogenic expander in accordance with claim 9 wherein the linearly activating actuator is configured to control a degree to which the switch valve is opened to control the pressure drop.

11. The cryogenic expander in accordance with claim 1 wherein the displacer stays at the warm end or the cold end of the displacer cylinder until the pressure has reached the first or second pressure before the displacer moves towards the other end when cooling and heating.

12. The cryogenic expander in accordance with claim 1 wherein the ports at the first radius are connected to the warm displaced volume of the displacer cylinder.

13. The cryogenic expander in accordance with claim 1 wherein the displacer assembly further comprises cold inlet and outlet valves connected to the cold displaced volume of the displacer cylinder, and wherein:

the ports at the first radius are connected to the valve actuators;

the valve actuators comprise a first valve actuator to open the inlet valve when the first valve actuator is connected to the first pressure of the compressor; and the valve actuators comprise a second valve actuator to open the outlet valve when the second valve actuator is connected to the first pressure of the compressor.

14. The cryogenic expander in accordance with claim 1 wherein the heating port is located closer to one of the ports at the first radius than the cooling port.

* * * * *